US005101648A

United States Patent [19]

Kuster

[11] Patent Number: 5,101,648

[45] Date of Patent: Apr. 7, 1992

[54] LOCK CYLINDER AND KEY WITH ASSOCIATED SECURITY ELEMENT

[75] Inventor: Heinz Kuster, Wetzikon, Switzerland

[73] Assignee: Bauer Kaba AG, Wetzikon, Switzerland

[21] Appl. No.: 598,769

[22] Filed: Oct. 15, 1990

Related U.S. Application Data

[63] Continuation of Ser. No. 380,455, Jul. 12, 1989, abandoned.

[30] Foreign Application Priority Data

Aug. 27, 1988 [CH] Switzerland ..... 03 184/88-2

[51] Int. Cl.[5] ..... E05B 27/06

[52] U.S. Cl. ..... 70/358; 70/409; 70/493

[58] Field of Search ..... 70/493, 358, 378, 376, 70/392, 409, 421, 494, 406

[56] References Cited

U.S. PATENT DOCUMENTS

| | | | |
|---|---|---|---|
| 1,958,603 | 5/1934 | Bacon | 70/421 |
| 3,151,477 | 10/1964 | Balestrini | 70/421 |
| 3,293,893 | 12/1966 | Chesler | 70/378 |
| 3,348,392 | 10/1967 | Schreiber | 70/493 X |
| 3,393,542 | 7/1968 | Crepinsek | 70/493 X |
| 3,464,243 | 9/1969 | Hawkins | 70/493 |
| 3,494,157 | 2/1970 | Coker, Jr. | 70/421 |
| 3,656,328 | 4/1972 | Hughes | 70/493 X |
| 4,193,277 | 3/1980 | Lo | 70/493 X |
| 4,289,002 | 9/1981 | Gretler | 70/358 |
| 4,325,241 | 4/1982 | Keller | 70/493 X |
| 4,631,941 | 12/1986 | Sjunnesson | 70/493 X |

FOREIGN PATENT DOCUMENTS

| | | | |
|---|---|---|---|
| 2577969 | 8/1986 | France | 70/493 |
| 430219 | 10/1974 | U.S.S.R. | 70/493 |

*Primary Examiner*—Lloyd A. Gall
*Attorney, Agent, or Firm*—Walter C. Farley

[57] ABSTRACT

A lock cylinder with key, in which the cylinder has a rotor and a stator with radial tumbler pins and the key has depressions corresponding to the tumbler pins, has at least one tumbler pin exercising the function of a control pin (K), in that a zone formed by an offset is used for a flank code (f), provided in addition to the depth code (T) and having a diameter (B) corresponding to an additional code and the associated key has a depression with side flangs (8), whose spacing corresponds to the coded diameter (B) of the offset of the control pin.

8 Claims, 3 Drawing Sheets

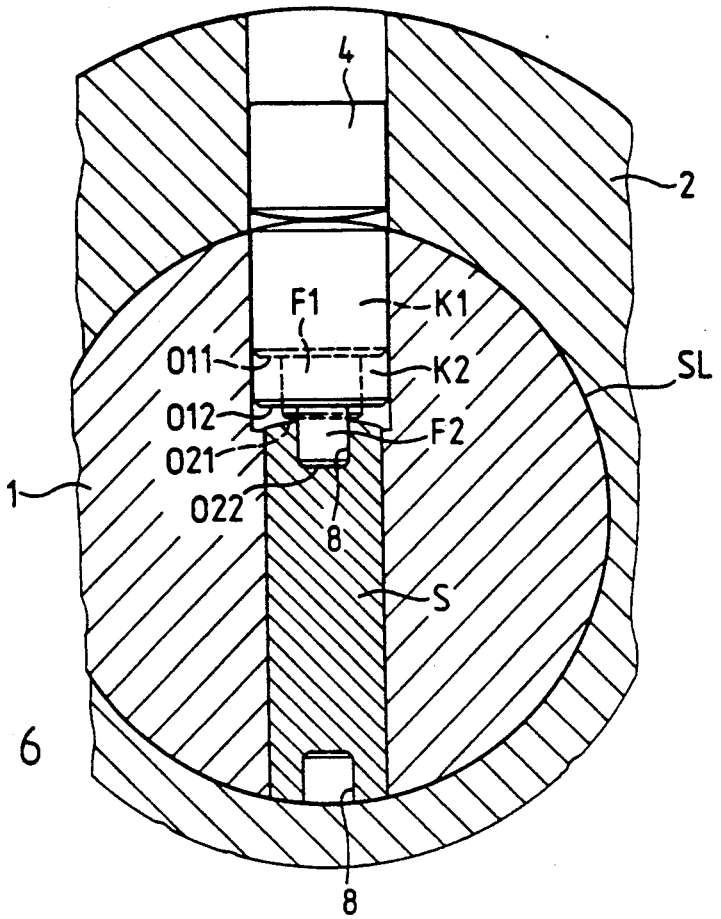
FIG. 6
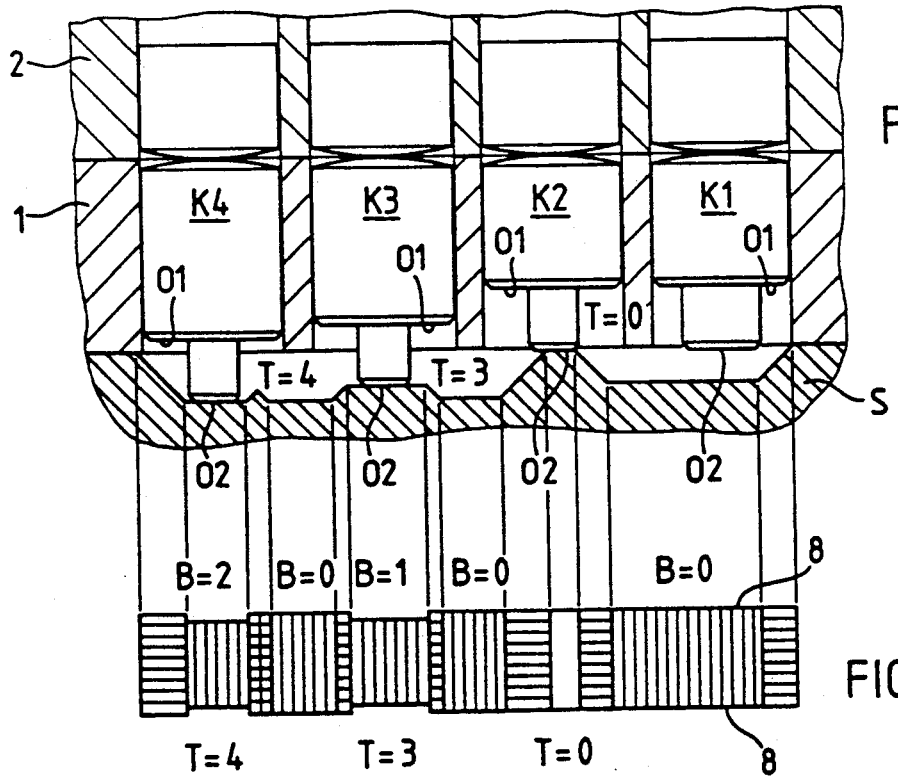
FIG. 7A
FIG. 7B

LOCK CYLINDER AND KEY WITH ASSOCIATED SECURITY ELEMENT

This is a continuation of application Ser. No. 830,455 filed July 17, 1989, now abandoned.

This invention is in the field of security technology and relates to a security device which, in cooperation with a lock cylinder and its key, makes the illegal copying or forging of keys more difficult.

BACKGROUND OF THE INVENTION

Legal protection measures forbidding the copying of keys and practical protection measures making such copying more difficult have been adopted. With regard to the practical measures, a distinction can be made between those which increase secrecy and those which make manufacture more difficult. With regard to the latter measures, the effort is to make manufacture so difficult due to mechanical conditions that only suitably equipped persons can manufacture such keys. Combinations of the above groups exist in order to bring about practical protection.

SUMMARY OF THE INVENTION

An object of the present invention is to provide a constructive measure making it much more difficult to produce key copies.

The inventive measure is described in greater detail hereinafter relative to an embodiment and the attached drawings, wherein:

FIG. 6 is a transverse sectional view through a lock and key showing another embodiment of flank coding, in which two tumbler pins are shown, whereof one of the depression flanks is controlled and the other is not;

FIGS. 7A and 7B are, respectively, a partial sectional vi of a lock and key and a schematic plan view of the key with tumbler pins controlling depression flanks together with those which do not control the flanks of the depressions shown;

DESCRIPTION OF THE PREFERRED EMBODIMENTS

Figure 1:
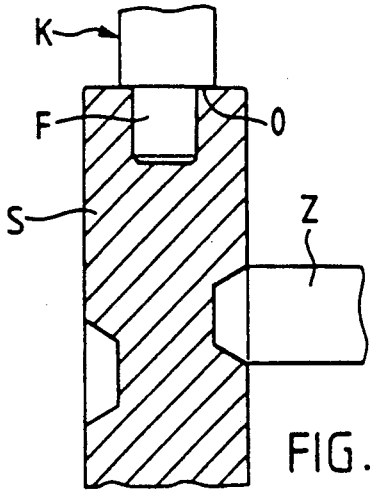
FIG. 1 is a transverse sectional view of part of the blade of a key S with a depression for a control pin K in the narrow side and a conventional tumbler pin on the broad side.

The invention is based on an observation made in connection with the copying of keys, which has now expanded to something which can be likened to a "spares creation market". It is no longer a question of replacing keys, but a market for the uncontrolled manufacture of copied or forged keys. It is clearly not within the interests of the locking system manufacturers and their customers if keys intended to only give selective access can be distributed in an uncontrolled manner. However, because for the key copier it is a profitable business, this development can hardly be stopped, but it can certainly be disturbed. Thus, with regards to the copying business, involving the manufacturer of the key copies, the manufacturer of the tools and the manufacturer of the key blanks, careful calculations have to be made to ensure that it makes economic sense. As a result nowadays the manufacture of key copies is highly automated and instead of skilled specialists with the corresponding knowledge, use is made of special machines, which can be operated by untrained persons. It is therefore possible for complicated keys to be copied by unskilled personnel using simple processes. This is an important aspect of the key copying market.

The invention makes use of this fact. The inventive measure breaks through this plan and makes it much more difficult to copy or forge (counterfeit) keys. It is directed at interrupting the automatic sequence of the copying machine and is particularly directed at making the unskilled copier carry out precautionary measures on the machine he is using, which are beyond his skill capacity. Therefore, the copying process can no longer be carried out with a copying machine without the participation of skilled personnel.

The presently used copy milling devices make use, in the manufacture of a false or skeleton key, of the sensing or following process of a cutting stylus with which it is possible to cut the depressions of the "drilling image". This cutting stylus makes the depressions in the blank in the way in which they are sensed by the attempted copier on the key to be copied. In most locking systems it is merely a question of the key having a depression of a first type with a depth holding the tumbler pin in the opening position. Thus, different key types can be copied with a single stylus, which offers the major advantage to a key copy manufacturer that he does not have to set up and adjust the copying machine for each key type. Therefore he is in the position of being able to produce top quality key copies with only moderately trained personnel. A non-standard key could only be copied with high effort and expenditure, because it would not be worthwhile to set up and adjust the equipment for a few or even a single key. Clearly, a key with such a security feature would offer more practical protection against unauthorized copying than a key without this measure.

This measure includes the formation of one or more additional and/or existing tumbler pins to control pins controlling a further code corresponding with a key depression of a second type, which cannot be readily simulated on the copy milling means by the forger/-stylus. For the formation of such corresponding depressions, there is a further development of an earlier method patented by the Applicants assignee and which is incorporated into the present invention. This method is known from Swiss patent 591 618 (U.S. Pat. No. 4,289,002).

Either the forger must not be able to sense the depression in the way which would be necessary for copying, or he must not be able to produce the depression with the stylus in the way necessary for a satisfactory function. The minimum requirement necessitates the adaptation of the copying machine to the new circumstances.

In the proposed constructive measure, the decisive point is no longer the depth scan, but a flank scan of the depression of the second type. Flank scan refers to the scanning or sensing of the distance between the edges of two facing flanks of a depression. What is decisive for the flank scan is no longer solely the depression depth, but also its width. The tumbler pin carrying out the flank scan (in order to distinguish it from a tumbler Z not controlling on the basis of the spacing of the flanks and hereinafter referred to as control pin K) must dimensionally correspond to a conventional tumbler pin and must in the vicinity of the shear line have the necessary shear resistance or diameter. The flank coding is obtained by shoulders defining an offset on the tumbler pin, which gives a diameter-variable (coded) scanning range. Thus, a bidimensional code is obtained, namely the depth steps $T_O$, $T_1$, $T_2$, $T_3$ etc., in conjunction with the flank steps $F_0$, $F_1$, $F_2$, etc., which is very sensitive with respect to the hitherto used "volume milling", with which a depression of the first type is made with a random diameter stylus in the blank, the action continuing until the necessary height stage is reached. A tumbler pin only coded in a single dimension, i.e., unidimensional, will sink out of its own bore into the "unqualified" depression and will free the shear line whenever the depression has the correct depth. However, in the case of a bidimensional coding the correct setting in the direction of the tumbler displacement, i.e., one dimension in such a way that the shear line could be freed, will in no case be successful unless the flank spacing, i.e., the other dimension, simultaneously matches.

The realization of a further, third, dimension of the code is technically without interest, because the relative movement between the tumbler and the key and the need for inserting and removing the tumbler with respect to the depression does not allow a code. However, the offset resulting from the flank code can be used as an additional binary code $O_1$ and $O_2$. Thus, a single one of the proposed control tumblers with e.g. $O_1$, $O_2$; $T_0$, $T_1$, $T_2$, $T_3$; $B_0$, $B_1$, $B_2$ has a code with 24 possibilities. Even in the case of a tool change and new setting-up and adjustment, there is no better than a 1:1 chance of obtaining a correctly functioning key, because namely the parameters $O_1$ and $O_2$, mounting on the offset and mounting on the face, can still not be clearly and unambiguously determined.

Thus, this measure realizes the aforementioned objective, very effectively prejudicing the copying action. It is also not possible to determine the O-parameter (the mounting face) and it can only be reduced with an uncertainty of 1:1.

For the less qualified key forger, who expects a constant copying characteristic on the part of his machine, a key having a depression for one or more control pins represents a major obstacle in two respects, namely the detection of such a depression and the performance of the correct measures for obtaining an operable copy. This measure involves the resetting and adjustment of his machine, generally for only a single key, which (in order to be profitable) must be no more expensive than any other key of the type which does not make such additional measures necessary.

For the legitimate copier or key manufacturer who manufactured the original key and who always has the necessary measures for copying purposes (e.g. a copying plant permitting a multiple passage in the same operation) and who, from the purely organizational standpoint, can spread the extra expenditure over a large number of keys to be copied, said measure, which gives the consumer additional security, does not represent an additional cost factor.

FIG. 1 diagrammatically shows a key S, in whose narrow side is provided a depression for a control pin K and in whose flat (broader) side is provided a depression of the first type for a tumbler pin Z. In each of these two depressions a corresponding pin is indicated. With regards to the control pin the zone of the bidimensional code is indicated as a flank code with the letter F. The control pin can naturally also be located on the flat side.

Figure 2:
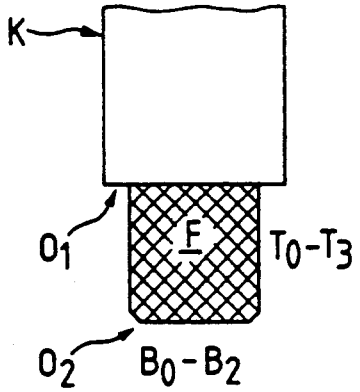
FIG. 2 is an enlarged partial view of one example of a control pin K with a flank coding F, in which the pin diameter, pin length and mounting faces $O_1$ and $O_2$ are used for coding purposes.

The different parameters of a control pin are shown in FIG. 2 and are constituted by the steps in the width of the pin, namely $B_0$–$B_2$ (three steps for flank scanning), the steps in the pin length, namely $T_0$–$T_3$ (four steps for depth scanning) and the two mounting faces $O_1$ and $O_2$, which can be selectively set with respect to the depth steps, either the end face or the offset face forming the reference face for the depth scan.

It is therefore possible to conceal in a successful manner the aforementioned 24 possibilities for a single pin.

Figure 3:
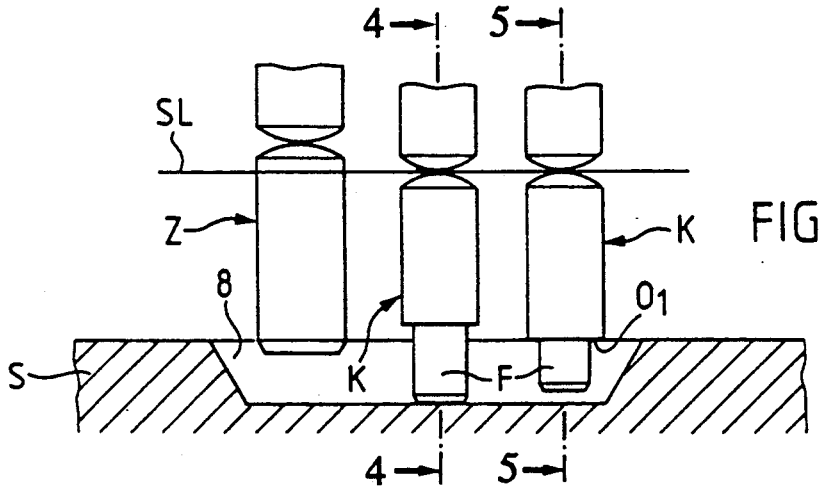
FIG. 3 is a side elevation of part of the blade of a key with depression for a control pin, in which one control pin is mounted on mounting face $O_1$ and another control pin on mounting face $O_2$, and a third pin which is a conventional tumbler pin, which is not affected by this structural measure.

FIG. 3 shows this concealment possibility on a longitudinal depression, in which are shown three pins blocking or freeing a shear line SL. The longitudinal depression is of the second type and thus is flank-coded, i.e., it is somewhat narrower than a normal depression of a type which would be found on standard keys. From left to right it is possible to see a normal tumbler pin Z the distal end of which, as a result of its larger diameter, cannot sink into the depression and therefore keeps the shear line SL blocked, but slides over such a flank-coded depression in the same way as if it was not present. The control pin K alongside it is both depth and length-coded relative to the mounting face $O_2$, being located on the bottom of the depression, and frees the shear line SL in the case of the correct length and thickness, so that an opening turn or rotation is possible. The control pin at the far right is both depth and length-coded with respect to the mounting face $O_1$, but its distal end is not located on the bottom of the depression and is instead positioned on the mounting face $O_1$, which is in turn depth-coded. This control pin also frees the shear line. In this case there is a 1:1 concealment of the depth code and on reading the cylinder it is not apparent which of the two mounting faces serves as the reference face for said code.

Figure 4:
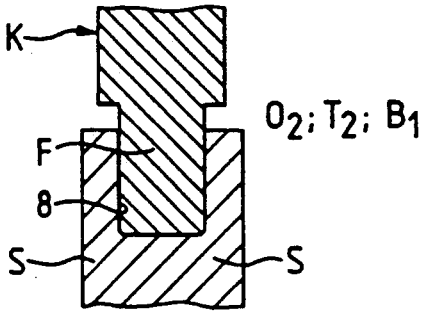
FIG. 4 is a cross-section along line IV—IV of FIG. 3.
Figure 5:
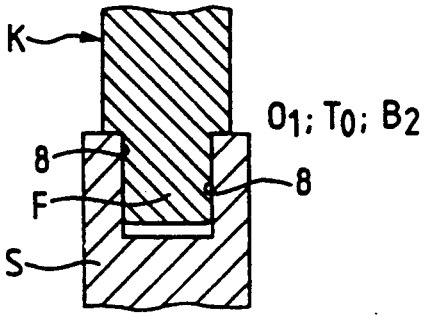
FIG. 5 is a cross-section along line V—V of FIG. 3.

FIGS. 4 and 5 show in detail the two right-hand control pins from FIG. 3 in the flank-coded depression of the second type in the key. As stated, it is only possible to distinguish between a flank-coded depression and a conventional depression by precise measurement, because the shape scarcely differs. The only difference is that of a few tenths of a millimeter in the depression width, which cannot be detected with the naked eye. FIG. 4 shows a control pin K in a corresponding depression in key S. For example, the code could read $O_2$; $T_2$; $B_1$, i.e., three parameters on the same control pin, and there can be one or more of these in a lock cylinder, while the associated key can have a corresponding number of flank-coded depressions. FIG. 5 also shows a control pin offering an equivalent copying hurdle and its code could e.g. be $O_1$; $T_0$; $B_2$. The depth code is related to the shear line SL or the mounting faces, so that the offset remains concealed as a possible reference. With the two control pins of FIGS. 4 and 5, the flank coding zone is designated F, FIG. 2 showing it in hatched form and in it there is a bidimensional coding.

FIGS. 6, 7A and 7B show an embodiment in which in inversely functioning manner a tumbler pin serves to control "illegal" flanks. The way in which this is carried out is explained hereinafter relative to FIGS. 8 and 10.

FIG. 6 shows a partial sectional view of a rotor 1 arranged in a stator 2. In a key channel of the rotor is located a key S with two flank-coded (second type) narrow side depressions (bottom and top) and their flanks 8. It is again pointed out that the flank-coded depressions can also be positioned on the key wide side and there can be one or more of these, together with non-flank-coded depressions of the first type. Sunk into the depression is shown a tumbler pin K2 controlling the flank code with the control part F2 and shoulders defining mounting faces 012 and 022. A further tumbler pin K1, located behind pin K2, is also shown and its control part F1 with mounting faces 011, 021 cannot be sunk into this depression. The two tumbler pins K1 and K2 are so arranged with respect to the shear line SL that the latter is only freed for an opening rotation. For completeness, a counter-tumbler 4 is also shown in stator 2.

Tumbler pin K1 is constructed in such a way that its control part F1 does not sink into any of the flank-coded depressions, e.g., as a result of a larger diameter than the largest flank spacing. Thus, tumbler pin K1 controls the key surface in such a way that any sinking blocks the shear line.

Similar to FIG. 3, FIG. 7A shows in a longitudinal section through stator 2, rotor 1 and key S a flank-coded row of depressions, one rear flank 8 being visible in each case. There are four tumbler pins K1 to K4 from right to left. Tumbler pin K1 is, as explained in conjunction with FIG. 6, the key surface-controlling tumbler pin and has a "sink barrier". Tumbler pins K2 and K4 are flank-coded pins with e.g., the following opening code:

K2(T=O;B=x); K3 (T=3;B-1); K4 (T=4,B=2), in which x is selectable

The row of depressions associated with this bidimensional code is shown in FIG. 7B, in which it is as seen from above. The horizontally hatched parts are sinking and raising surfaces with an appropriate angle of inclination, the vertically hatched parts are control surfaces for depth Tx, while the unhatched surfaces indicate the surface which, as stated hereinbefore, can also be a control surface.

It is readily apparent how the additional flank code can be used for making the copying process more difficult. A key with this code is much more sensitive to undesired copying. On an "unauthorized" copying machine a key is always obtained, but it cannot be used in the associated cylinder. Even though this constitutes the same obstacle for the legitimate owner of a key to be copied, it serves for his protection in much the same way as the protective measures in the banking field, which ensure that the legitimate user cannot get at his money with undue ease.

Figure 8:
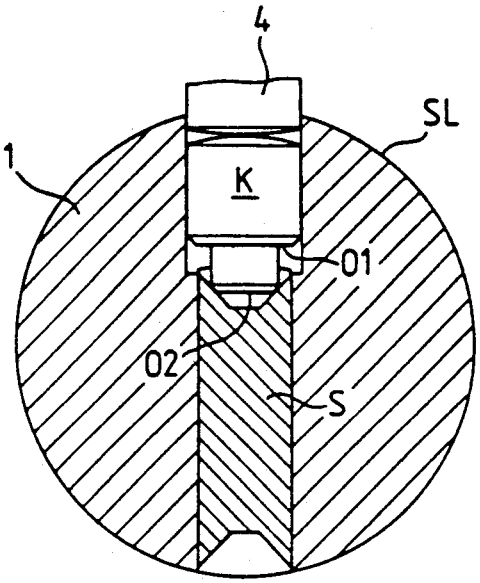
FIG. 8 is a transverse sectional view of a lock with a "bad" key copy in conjunction with a tumbler pin controlling the depression flanks.
Figure 9:
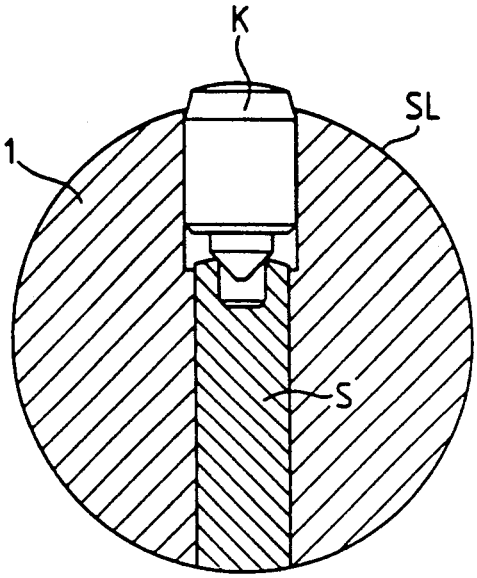
FIG. 9 is a transverse sectional view of a lock and key wherein a conventional tumbler pin rests in a flank-coded depression.

Certain of the obstacles resulting from this measure are shown in FIGS. 8–10, which show a lock cylinder rotor with key channel, as well as a key with a narrow-side depression in cooperation with a tumbler pin.

FIG. 8 shows a depression of the first type produced with a conventional copying milling means ignoring the flank condition and with a control pin sunk therein and which naturally keeps the shear line blocked. A tumbler pin controlling the key surface with the "sink barrier" would also keep the shear line blocked.

Figure 10A:
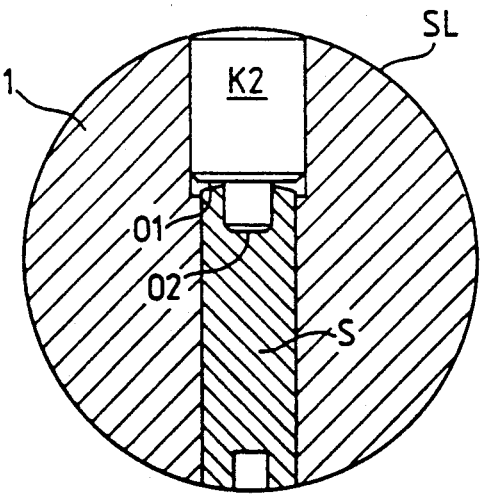
FIGS. 10A and 10B are transverse sectional views of locks and keys, using the arrangement of FIG. 6 with a control pin inserted in the flank-coded depression and such a pin not inserted (acting as a sink barrier), respectively.
Figure 10B:
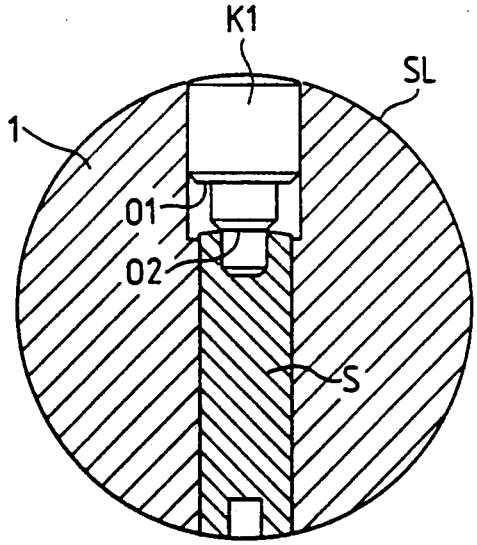

FIG. 9 shows the effect when a normal tumbler pin is moved over a flank-coded depression, the shear line remaining blocked. FIGS. 10A and 10B each show a flank-coded depression, which can bring a flank-coded tumbler pin into the opening position (FIG. 10A) or a tumbler pin having shoulder means engaging the edges of the depression and the insertion depth thus being controlled by contact with the key surface (FIG. 10B). This illustrates the double protection action provided by this solution. If e.g. a conventional depression is milled, in the manner shown e.g. in FIG. 8, with a depth which would bring the flank-coded tumbler pin into the correct depth position, then a tumbler pin with sink barrier cooperating with the same depression, i.e., a tumbler pin controlling the key surface, would prevent an opening of the shear line. This example illustrates the increased security when using flank coding and/or flank scanning of flank-coded and non-flank-coded tumbler pins in interplay with the depressions in the key.

If only some tumbler pins are constructed with the corresponding depressions in the key in accordance with the proposed measure, then illegal copying could simulate some depressions, whereas the flank-coded depressions would acquire an incorrect shape, (e.g. FIG. 8), in which neither the flank-coded tumblers, nor the surface-controlling tumblers with the sink barrier could be placed in such a way as to free the shear line.

A key with a depression which can correspond with the control pin in the lock cylinder, has two flanks 8 with the desired spacing, between which a tumbler pin controlling the flanks can sink and then rise again (cf. also FIGS. 3–5), or on which is placed a surface-controlling tumbler pin (control pin) with a sink barrier. Such depressions can in particular be manufactured by the aforementioned milling method of the Applicant, which is described in U.S. 4,284,002. This method, known as the continuous path milling method, permits the extremely precise manufacture of depressions having such flanks. It is also possible to easily produce a sequence of depressions, as shown in exemplified form in FIG. 7A.

A lock cylinder with key, which has the structural features in accordance with the invention, provides greater security against key copying or forging by copy milling than was hitherto the case. A key forger who finally manages to establish that there is a flank code and who has located the particular depressions, must then reequip and readjust a copy milling machine and this may be necessary two to three times. Until he has done this, he has in all probability already incorrectly drilled one or more key blanks. It is to be assumed that he will be discouraged from copying further such keys, so that the proposed technical measure achieves the objective of offering an effective hurdle with respect to unauthorized copying or forging.

What is claimed is:

1. A lock and key combination of the type wherein the lock has a cylinder with a rotor and a stator with generally radial tumbler pin means each including a plurality of tumbler pins including an inner tumbler pin and having a separable location positionable at the interface between the rotor and stator to allow operation of the lock, the rotor having a key slot, and wherein the key includes a plurality of depressions extending into the key from the key surface and positioned to correspond with the locations of the tumbler pin means when the key is inserted into the key slot, the improvement wherein said key includes a depression of a first type having a bottom surface and a predetermined depth;

a first one of said tumbler pin means positioned for cooperation with said depression of said first type and having an inner tumbler pin with an end portion shaped and dimensioned to enter said depression and contact said bottom surface thereof, the radial position of said inner tumbler pin and the separable location in said first tumbler pin means being determined by the depth of insertion of said end portion into said depression of said key includes a depression of a second type having a bottom surface and inwardly facing, substantially planar, parallel side while terminating at edges at a key surface, said edges being substantially parallel with each other and spaced apart by a predetermined distance; and a second one of said tumbler pin means positioned for cooperation with said depression of said second type and including a second inner tumbler pin having shoulder means for engaging said edges of said side walls at said surface of said key and a distal end portion shaped and dimensioned to enter said depression between said side walls, the radial position of said second inner tumbler pin and the separable location in said second tumbler pin means being determined by the contact of said shoulder means with said edges without regard to the depth of insertion of said distal end portion into said depression of said second type, whereby said key and lock includes two distinct types of coding.

2. A combination according to claim 1 wherein said key includes at least two depressions each having two inwardly facing, parallel side walls perpendicular to an adjacent key surface, and wherein the spacing between said side walls in one said depression is greater than the corresponding spacing in the other said depression.

3. A combination according to claim 1 wherein said distal end of said second inner tumbler pin is formed with steps defined by portions of different diameters and the spacing of said side walls of said depression of the second type is selected to admit a selected number of said portions.

4. A combination according to claim 1 wherein said distal end portion of said second inner tumbler pin is spaced from the inner end of said depression of said second type when said shoulder means engages said edges.

5. A combination according to claim 1 wherein said key includes a plurality of depressions of said first type and a plurality of tumbler pin means with inner tumbler pins for cooperation therewith.

6. A combination according to claim 1 wherein said key includes a plurality of depressions of said second type and a plurality of tumbler pin means with second inner tumbler pins for cooperation therewith.

7. A combination according to claim 1 wherein said distal end portion of said second one of said tumbler pin means has a cylindrical outer surface of a first diameter no greater than said predetermined distance, said second inner tumbler pin includes a second substantially cylindrical portion having a diameter larger than said predetermined distance and said shoulder means separates said distal end portion and said second substantially cylindrical portion.

8. A lock and key combination of the type wherein the lock has a cylinder with a rotor and a stator with generally radial tumbler pin means each including a plurality of tumbler pins including an inner tumbler pin and having a separable location positionable at the interface between the rotor and stator to allow operation of the lock, the rotor having a key slot, and wherein the key includes a plurality of depressions extending into the key from the key surface and positioned to correspond with the locations of the tumbler pin means when the key is inserted into the key slot, the improvement wherein each depression of said plurality of depressions has a bottom surface and inwardly facing substantially parallel side walls terminating at edges at said key surface;

said inner tumbler pins of said tumbler pin means each comprises a cylindrical end portion of a first diameter, an adjacent cylindrical portion having second, larger diameter and an abrupt shoulder therebetween, at least one of said inner tumbler pins has an end portion with a length at least as great as the distance between said key surface and said bottom surface such that the radial position of said tumbler pin means including said at least one inner tumbler pin and the position of the separable location therein is determined by contact between said end portion and said bottom surface; and at least one other of said inner tumbler pins has an end portion with a length smaller than said distance between said key surface and said bottom surface such that the radial position of said tumbler pin means including said at least one other inner tumbler pin and the position of the separable location therein is determined by contact between said shoulder and said key surface adjacent said edges.

* * * * *